US008025762B2

(12) United States Patent
Ravaska

(10) Patent No.: US 8,025,762 B2
(45) Date of Patent: Sep. 27, 2011

(54) COOKING AID FOR IMPROVING THE REMOVAL OF EXTRACTIVES IN PULP PRODUCTION, ITS PRODUCTION AND USE

(75) Inventor: Matti Ravaska, Oulu (FI)

(73) Assignee: Arizona Chemical B.V., Almere (NL)

( * ) Notice: Subject to any disclaimer, the term of this patent is extended or adjusted under 35 U.S.C. 154(b) by 176 days.

(21) Appl. No.: 10/540,499

(22) PCT Filed: Dec. 16, 2003

(86) PCT No.: PCT/FI03/00962

§ 371 (c)(1),
(2), (4) Date: Apr. 17, 2006

(87) PCT Pub. No.: WO2004/057101

PCT Pub. Date: Jul. 8, 2004

(65) Prior Publication Data

US 2006/0231791 A1 Oct. 19, 2006

(30) Foreign Application Priority Data

Dec. 23, 2002 (FI) ..... 20022270

(51) Int. Cl.
*D21C 3/20* (2006.01)
*D21C 9/08* (2006.01)

(52) U.S. Cl. ..... 162/75; 162/72

(58) Field of Classification Search ..... 162/72, 162/75

See application file for complete search history.

(56) References Cited

U.S. PATENT DOCUMENTS

| | | | | |
|---|---|---|---|---|
| 2,074,473 | A | 3/1937 | Jayme | |
| 2,144,756 | A | 1/1939 | Fritz | |
| 4,673,460 | A | 6/1987 | Raff | |
| 5,298,120 | A * | 3/1994 | Blackstone | 162/76 |
| 6,084,061 | A * | 7/2000 | Lawson et al. | 530/230 |
| 7,255,873 | B2 * | 8/2007 | Nakata | 424/438 |

FOREIGN PATENT DOCUMENTS

GB 1129053 10/1968

OTHER PUBLICATIONS

Pine Chemicals Association, Test Plan for Tall Oil Fatty Acids and Related Substances, May 23, 2001, PCA.*

G.A. Smook, Handbook for Pulp and Paper Technologists, 1992,Angus Wilde Publications,2nd edition, p. 74-77.*

Magee Thomas et al., Composition of American Distilled Tall Oils, 1991, Forest Product Laboratories, entire document.*

Products on Sale at Arizona Chemical [online] , Feb. 2002, retrieved from www.archive.org.*

Smook, Handbook for Pulp and Paper Technologists, 1992, Angus Wilde Publications, 2nd edition, p. 38-39.*

Dunlap-Jones et al., The Effects of Certain Chemical Additives on the Deresination of Trembling Aspen in Kraft Pulping, 1989, Journal of Wood Chemistry and Technology, 9(3), 365-386.*

Sylvatal D40LR Distilled Tall Oil Product Data Sheet, Feb. 2004, Arizona Chemical Company, whole document.*

Wolff Robert, All-cis 5,11,14-20:3 Acid:Podocarpic Acid or Sciadonic Acid, 1999, JAOCS, vol. 76, No. 10, whole document.*

Gao Yong, Biodgredation of Lipis by Wood Sapstaining Ophiostoma Spp,1996, University of Bristich Columbia, p. 17 Table 1.1.*

Dr. Art Ragauskas, Properties of North Americanwood [downloaded online. www.ipst.edu], downloaded on Mar. 30, 2011.*

Arizona Chemical, ACINTOL S40DD Distilled Tall Oil Data sheet, submitted by the applicant Oct. 22, 2010.*

C.E. Farley, "Causes of Pitch Problems and a Laboratory Method of Evaluating Control Agents", 1977, TAPPI Papermakers Conference, p. 23-32.*

E. Hagglund, *Academic Press Inc.*, "Chemistry of Wood", pp. 490-491 (1951).

Aspen; from Wikipedia (web address and date printed given on face of document), Mar. 17, 2011.

Birch; from Wikipedia (web address and date printed given on face of document), Mar. 17, 2011.

Sweep's Library; Firewood Comparison Charts; from Chimneysweep online website (web address and date printed given on first sheet of document), Mar. 17, 2011.

Verso Paper (data sheet) & Karttunen and Stephenson (article); Quennesec Hi-Maple Northern Hardwood Pulp (data sheet) & Maple—the Ideal Hardwood Pulp (article); from verso paper website (web address and date printed given on first sheet of document), Mar. 17, 2011.

* cited by examiner

*Primary Examiner* — Matthew Daniels
*Assistant Examiner* — Anthony Calandra

(57) ABSTRACT

The present invention relates to a wood cooking aid which comprises a mixture of fatty acids and rosin acids and/or salts thereof in a ratio which is effective in removing the extractives in pulp production. The invention also relates to a method for preparing a wood cooking aid wherein fatty acids and rosin acids are provided in a mixture in a ration which is effective in removing the extractives in pulp production. If desired salts of said acids are prepared by reacting said fatty acid rosin acid mixture containing the desired fatty acid and rosin acid distribution with water and sodium hydroxide. The wood cooking aid of the invention is used in cooking of hardwood.

9 Claims, No Drawings

COOKING AID FOR IMPROVING THE REMOVAL OF EXTRACTIVES IN PULP PRODUCTION, ITS PRODUCTION AND USE

FIELD OF INVENTION

This invention relates to a novel wood cooking aid which can be used in cooking of wood in order to improve the removal of extractives in pulp production. The present invention also relates to a method for preparing a novel wood cooking aid.

BACKGROUND OF THE INVENTION

The pulp industry especially in Scandinavia uses both softwood and hardwood as a raw material. The most important tree varieties used in pulping are pine, spruce and birch. In the pulping process wood is chipped into small particles which are then cooked in the presence of alkaline liquor, such as sodium sulfide and sodium hydroxide, at a temperature of about 150° C. to 170° C. During cooking the inherent adhesive of wood, lignin, dissolves in the aqueous solution and the fiber material is released and recovered as a raw material for paper.

When softwood is cooked, lignin and other extractives in the wood are released relatively easily. When hardwood is cooked, the extractives are not released as easily as from softwood because of the different chemical structure of softwood and hardwood and, thus, part of the extractives remains in the fibers. The extractives remaining in the fibers cause problems in the production of paper. The extractives cause problems especially when birch is used in the pulping.

During cooking the sodium salts of carboxylic acids, fatty acids and rosin acids wash out the extractives from cellulose. Softwood contains both fatty acids and rosin acids and the extractives are removed easily during cooking. Hardwood like birch, on the other hand, contains only fatty acids and no rosin acids at all. The fatty acids in birch are not able to wash out the extractives from birch during the pulp production. Fatty acids are mainly in an esterified form in the wood, whereas rosin acids exist as free acids. Fatty acid esters are degraded during the cooking process. Free fatty acids form sodium salts which are water soluble and act like detergents. However, in the case of birch the extractives are not washed out in the same way.

The problem with birch cooking can be avoided by using crude tall oil obtained from softwood cooking. The fatty acids and rosin acids of the crude tall oil improve the removal of the extractives from birch since they act as surfactants.

Textbooks in the technical field of the present invention teach that it is usual to add crude tall oil or black liquor soap to birch cooking in order to decrease the amount of extractives in the pulp. This is mentioned e.g. in the textbook of the Finnish Paper Engineers' Association called: Puumassan valmistus II osa 2, page 1341 (Production of pulp II, part 2). The addition of crude tall oil or black liquor soap both improves the separation of soap and the quality of pulp in the cooking of birch.

The prior art methods, however, are not sufficiently effective in removing the extractives and thus some of the extractives remain still in the pulp after cooking. Some of the agents used in the prior art are also very expensive and the use thereof raises cost. Some agents, on the other hand, are difficult to dispose of after use which make them less practical in use. Thus, there is a need for a more efficient way of removing extractives from hardwood which is technically feasible and also cost-effective in use.

It has now been found that certain wood cooking aids provide an effective way to remove extractives during cooking. Effective removal of the extractives ascertains pure pulp which does not cause problems in paper production.

SUMMARY OF THE PRESENT INVENTION

It is an object of the present invention to provide a wood cooking aid which improves the removal of extractives during wood cooking processes. The inventors have found that the use of a wood cooking aid with a controlled fatty acid and rosin acid distribution enables obtaining good quality pulp when the fatty acids and rosin acids and/or salts thereof are chosen based on their performance in removing the extractives.

The fatty acids and rosin acids and/or salts thereof together in a ratio which is effective in removing the extractives ascertain that the wood cooking aid is effective in the removal of the extractives also in cases where the wood is difficult to cook with conventional cooking aids, e.g. crude tall oil. The wood cooking aid of the present invention is also a natural and cheap product which is easy to dispose of after use.

In a preferred embodiment of the present invention a wood cooking aid said salts are soaps of said acids and said fatty acid rosin acid mixture contains less than about 15%, preferably less than about 10%, more preferably less than about 5% unsaponifiable material. Saponification of such a mixture provides a wood cooking aid having the same low level of unsaponifiable material. A low amount of unsaponiable material is important since it is harmful during the pulp production because the unsaponifiables can act as extractives themselves. The wood cooking aid of the present invention contains less unsaponifiable material than e.g. crude tall oil used in the prior art. Thus, the wood cooking aid does not itself add to the amount of harmful material but ensures obtaining purer pulp from wood.

In a preferred embodiment of the present invention said fatty acid rosin acid mixture about 20 to about 98%, preferably about 35 to about 80%, more preferably about 50 to about 70% rosin acids and about 70 to about 2%, preferably about 55 to about 15%, more preferably about 45 to about 25% fatty acids. The soap composition which can be prepared from said fatty acid rosin acid mixture by saponification will have the same percentages of rosin acids and fatty acids as the initial mixture.

The wood cooking aid of the present invention may also be produced by mixing salts of fatty acids and salts of rosin acids to provide a desired composition.

In a preferred embodiment of the present invention the rosin acids or at least a major part of the rosin acids in the wood cooking aid comprise tall oil rosin acids, preferably abietic acid, dehydroabietic acid and/or palustric acid. Also pimaric acid and 8,15-pimaric acid are preferred rosin acids in the present invention. It is also possible to use rosin acids derived from e.g. gum rosin.

In another preferred embodiment of the present invention the fatty acids in the wood cooking aid comprise vegetable based fatty acids and/or animal based fatty acids, e.g. tallow.

In yet another preferred embodiment of the present invention the fatty acids in the wood cooking aid comprise unsaturated fatty acids. In an especially preferred embodiment of the invention said fatty acids comprise oleic acid, linoleic acid and/or pinolenic acid.

The fatty acids in the present invention can be either linear or branched. In a preferred embodiment of the present invention said fatty acids comprise branched fatty acids. The most preferred fatty acids are unsaturated branched fatty acids.

Also conjugated fatty acids, synthetic fatty acids and/or cyclic fatty acids can be used in the present invention.

In yet another preferred embodiment of the present invention said fatty acids comprise the monomer part produced during the dimerization of fatty acids. In an especially preferred embodiment of the present invention the amounts of said fatty acids in said monomer comprise are branched oleic acids 13 to 20%, branched stearic acids 7 to 20%, oleic acid 15 to 25%, other fatty acids 28 to 58% the rest being unsaponifiable material. The fatty acid content of said monomer part more preferably comprises branched oleic acids about 14 to about 16%, branched stearic acid about. 13 to about 15%, oleic acid about 19 to about 21%, other fatty acids about 42 to about 44%.

In a preferred embodiment of the present invention said fatty acids and said rosin acids are derived from tall oil. It is also possible to use fractions of distilled tall oil which contain preferred fatty acids and rosin acids. Such especially preferred fatty acids are 5,11,14-C20:3 and 11,14-C20:2, which are also obtained from a fraction of distilled tall oil.

In another preferred embodiment of the present invention said fatty acids salts and said rosin acids salts in the wood cooking aid are derived from distilled tall oil and/or tall oil rosin and/or tall oil fatty acids.

In a method for preparing the wood cooking aid according to the present invention fatty acids and rosin acids are provided in a mixture in a ratio which is effective in removing the extractives in pulp production. If desired salts of said acids are prepared by reacting said fatty acid rosin acid mixture containing the desired fatty acid and rosin acid distribution with water and sodium hydroxide.

The reaction is preferably performed in a pressure reactor at a temperature above 100° C. In a preferred embodiment of the present invention said reacting is performed in a continuous reactor.

The wood cooking aid of the present invention is used in the pulp production, preferably in cooking of hardwood. The wood cooking aid of the present invention is especially effective in cooking of birch.

DETAILED DESCRIPTION OF THE INVENTION

The present inventors have surprisingly found that the content of extractives can be lowered by replacing the crude tall oil previously used in the cooking with a more effective wood cooking aid. The wood cooking aid of the present invention has a fatty acid and rosin acid distribution which makes the extractives more easily soluble during the cooking process and therefore it is more effective in washing out the extractives than crude tall oil.

A "wood cooking aid" of the present invention is a composition of fatty acids, rosin acids and/or salts thereof as well as a low amount of unsaponifiable material and it is used in pulp production in order to improve the removal of extractives from wood.

"Extractives" are a large number of diverse substances which are obtained from wood by extracting. The extractives are soluble either in neutral organic solvents or water.

A "fatty acid rosin acid mixture" of the present invention is a mixture of fatty acids, rosin acids and/or salts thereof as well as unsaponifiable material which is used as a wood cooking aid which, if desired, can also be saponified in a reaction with water and alkali (e.g. sodium hydroxide) when the salts of said acids is prepared.

"Tall oil" as used in this description and the claims means by-product obtained from wood in kraft pulping. "Crude tall oil" is obtained by acidifying the tall oil soap recovered from black liquor and it contains fatty acids, rosin acids and neutral i.e. unsaponifiable materials.

"Unsaponifiables" are neutral substances found in the tall oil which include higher fatty alcohols, esters, plant sterols and some hydrocarbons. Unsaponifiables are inactive substance which may even act themselves as harmful extractives in the paper making.

"Rosin acids" are monocarboxylic diterpene acids, the most common of which is abietic acid. "Tall oil rosin acids" are obtained by fractional distillation of crude tall oil.

Distilled tall oil is obtained when tall oil is distilled and distillation fractions are recovered. Distillates of tall oil are pure tall oil fatty acid, pure rosin and so called distilled tall oil. All of the distillates have a very low content of unsaponifiables.

"Tall oil fatty acids" means the fatty acids obtained from the crude tall oil by distilling. Tall oil fatty acids in the present invention usually have a chain length C14 to C24.

The fatty acids are designated according to their carbon chain length and number of double bonds according to a standard nomenclature wherein e.g. C18:0 indicates a chain length of 18 carbon atoms and no double bonds while C20:4 indicates a chain length of 20 carbon atoms and 4 double bonds. The position of any double bonds is indicated by numbers e.g. as 9,12-18:2 wherein 9 and 12 indicates the positions of the two double bonds.

"Unsaturated fatty acids" are fatty acids which have double bonds in their carbon backbone. "Branched fatty acids" are fatty acids which have a branched carbon backbone. A monomer part of fatty acids is obtained during dimerization of fatty acids. "Vegetable based fatty acids" are fatty acids which are obtained from vegetables. "Animal based fatty acids" are fatty acids which are derived from animals, and include e.g. tallow.

The removal of extractives from hardwood is very difficult to achieve, especially from birch in such a way that extractives effectively removed. The inventors of the present invention have found that it is possible to prepare an effective wood cooking aid from fatty acids and rosin acids and that when the fatty acids and rosin acids in the wood cooking aid are selected in a controlled manner, a composition is obtained with an improved ability to remove extractives during the cooking process. Various fatty acids and rosin acids have different ability to remove the extractives.

An important property of the wood cooking aid of the present invention is its solubility in the cooking liquor. Fatty acids and rosin acids in the soap have a hydrophobic backbone with hydrophilic carboxylic groups which make them effective in dissolving extractives in cooking. Sodium salts of saturated fatty acids do not dissolve in water as well salts of unsaturated fatty acids. Sodium salts of rosin acids dissolve better in water than the corresponding sodium salts of fatty acids. Therefore, a proper distribution of fatty acids and rosin acids is an important factor in the effectiveness of the wood cooking aid of the present invention.

In the present invention a wood cooking aid is designed especially to have a controlled distribution of fatty acids and rosin acids to maximize removal of extractives in pulp production also with raw material which has been difficult to cook.

The wood cooking aid provides more effective results in pulp production than e.g. crude tall oil which has been used before because the fatty acid and rosin acid distribution of crude tall oil cannot be controlled. The wood cooking aid of the present invention has a controlled distribution of fatty acids and rosin acids as well as a low concentration of unsaponifiable material, which makes it more effective than e.g. crude tall oil.

If desired a fatty acid rosin acid mixture containing a mixture of fatty acids, rosin acids and unsaponifiable material is used as a starting material in the saponification reaction with water and alkali (sodium hydroxide) when salts of fatty acids and rosin acids are prepared.

The fatty acids and rosin acids of the present invention are derived from various sources. The wood cooking aid of the present invention may also be prepared by including distilled tall oil with a high rosin acid content into a fatty acid rosin acid mixture which is then, if desired, used for preparing the salts of fatty acids and rosin acids. The preferred tall oil rosin acids in the present invention are abietic acid, dehydroabietic acid or palustric acid.

It is also possible to use tallow fatty acids or gum rosin in the wood cooking aid of the present invention. It is also possible to use fatty acids derived from vegetables in the wood cooking aid of the present invention. In the present invention also conjugated fatty acids, synthetic fatty acids, cyclic fatty acids etc. may be are used as fatty acid ingredients.

When crude tall oil is distilled the main distillates are pure tall oil fatty acid, pure rosin and so called distilled tall oil. All of the distillates have a very low content of unsaponifiables. Therefore these distillates are very good raw materials for the fatty acid rosin acid mixture which is used in the wood cooking aid of the present invention for lowering the extractives of pulp.

Distilled tall oil is obtained when tall oil is distilled and distillation fractions are recovered. The fractions contain fatty and rosin acids the boiling points of which are so near to each other that they do not separate during the distillation. This fraction is commonly called "distilled tall oil" These fractions can be used as such in the present invention. A preferred fraction of distilled tall oil contains 5,11,14-C20:3 and 11,14-C20:2 fatty acids. These are unsaturated fatty acids and therefore the sodium salts thereof dissolve easily in water acting thus as surfactants. Thus, a wood cooking aid of the present invention containing these fatty acids is effective in removing the extractives.

Unsaturated fatty acids are more preferable in the present invention since the sodium salts thereof dissolve in water better than sodium salts of saturated fatty acids. Oleic acid, linoleic acid or pinolenic acid are unsaturated fatty acids which are preferably used in the present invention.

Branched fatty acids are effective in removing the extractives and therefore they are preferable in the wood cooking aid of the present invention. The preferred branched fatty acids used in the present invention are branched oleic acids, branched stearic acids and oleic acid.

A monomer part containing specific fatty acids is derived from the preparation of fatty acid dimers. A monomer part usually contains branched oleic acids, branched stearic acids, oleic acid and other fatty acids and unsapnifiable material. Since branched fatty acids are preferable in the wood cooking aid of the present invention it is preferable to use a monomer part containing such fatty acids in the composition.

The salts of acids in the wood cooking aid of the present invention may be prepared with a conventional reaction method for saponification. Conventional equipment can be used in the method. The reaction is performed at an elevated pressure or in atmospheric pressure. It is, however, preferable to use a pressure reactor which enables reaction at high temperatures. The temperature is then preferably above 100° C. The high temperature is preferred since it shortens the reaction time.

When the reaction is performed in normal pressure the temperature used is lower and the reaction time is longer.

The saponification reaction is preferably performed in a continuous reactor. This enables a continuous and economic way for performing the reaction.

The wood cooking aid of the present invention is used as sodium salts in aqueous solution because the conditions in cooking are alkaline. However, the composition may contain free alkali or it may be acidic.

The wood cooking aid of the present invention is especially useful in pulp production. The wood cooking aid of the present invention has a distribution of fatty acids and rosin acids or salts thereof which is effective in removing extractives from hardwood during cooking. The wood cooking aid is preferably used in cooking of birch. Birch is difficult to cook since it has no rosin acids at all and more fatty acids than softwood. The wood cooking aid of the present invention provides rosin acids into the cooking which facilitates the removal of extractives from birch.

The dry matter content of the wood cooking aid of the present invention is preferably from about 20 weight % to about 70 weight %. If the dry matter content of the product is low the volumes of the composition are higher and this incurs additional costs. If the dry matter content is high the viscosity of the product rises so that the pumping thereof is difficult.

The percentages of the components in the present description and claims are calculated on the total weight of the fatty acid rosin acid mixture.

The following non-limiting examples further illustrate the invention.

EXAMPLE 1

A wood cooking aid according to the present invention was prepared by mixing together 84.8 g tall oil rosin and 35.2 g distilled tall oil with a rosin acid content of 30% so that they dissolved. The rosin acid content of the fatty acid rosin acid mixture obtained was 72%, the fatty acid content 23% and unsaponifiables 5%.

64.3 g of the fatty acid rosin acid mixture obtained above, 127.2 g water and 8.5 g solid sodium hydroxide were weighed and placed in a pressure reactor and mixed at the temperature 120° C. for 30 minutes. Then the wood cooking aid obtained was cooled to room temperature (about 20° C.).

The dry substance content of the wood cooking aid was analyzed using an Infra-red drier, 160° C., 15 minutes. Free alkali content was analyzed by HCl titration and the viscosity was analyzed using a Brookfield viscometer.

The wood cooking aid was analyzed and the properties thereof were:

| | |
|---|---|
| Dry substance content | 34.1% |
| Free alkali content | 0.12% |
| Viscosity at 50° C. | 67 mPa * s |
| Viscosity at 90° C. | 21 mPa * s |

The wood cooking aid was easily pumpable and it was used in cooking of birch pulp. The extractives were removed effectively from the pulp.

EXAMPLE 2

A wood cooking aid according to the present invention was prepared by mixing 99.0 g water, 5.8 g sodium hydroxide and 50.0 g distilled tall oil with a rosin acid content of 35% in a flask at the temperature of 95° C. for 2 hours. The rosin content of the fatty acid rosin acid mixture obtained was 36%, the fatty acid content 60% and unsaponifiables 5%. The wood cooking aid obtained was then cooled to room temperature.

The wood cooking aid was analyzed like in Example 1 and the properties thereof were:

| | |
|---|---|
| Acid number | 4.9 mg KOH/g |
| Dry substance | 32.7% |
| Viscosity at 50° C. | 214 mPa * s |
| Viscosity at 90° C. | 84 mPa * s |

The wood cooking aid was easily pumpable and it was used in cooking of birch pulp. The extractives were removed effectively from the pulp.

EXAMPLE 3

A mixture a 1200 g distilled tall oil with a rosin acid content of 30% and 300 g monomer containing branched fatty acids which was obtained from the production of fatty acid dimer were mixed together so that they dissolved. The fatty acid rosin acid mixture obtained had a rosin acid content of 28%, a fatty acid content 67% and unsaponifiables 5%

1292 g of the fatty acid rosin acid mixture obtained above was weighed into a reaction vessel and heated to 90° C. NaOH solution was prepared by dissolving 2558 g water and 150 g solid NaOH and the solution was slowly added into the fatty acid rosin acid mixture. The temperature of the mixture was kept at 90° C. during the addition. The wood cooking aid obtained was cooled to room temperature.

The product was analyzed like in Example 1 and the results were:

| | |
|---|---|
| Acid number | 4.7 mg KOH/g |
| Dry substance | 35.3% |
| Viscosity at 50° C. | 813 mPa * s |
| Viscosity at 90° C. | 257 mPa * s |

The viscosity of the wood cooking aid was still low enough to be pumpable at the temperature of 50° C. Also the acid number was low enough for not to consume the alkaline liquor used in the cooking. The extractives were removed effectively from the pulp in cooking of birch pulp.

EXAMPLE 4

A wood cooking aid according to the present invention was prepared by adding 127.2 g water, 8.7 g sodium hydroxide and 64.3 g tall oil rosin the rosin acid content of which was 92.3%, fatty acids 4.8% and unsaponifiables 2.9% into a pressure reactor. The temperature of the reactor was raised to 120° C. and the mixture was mixed for 30 minutes. After this the reactor was cooled down to room temperature.

The rosin wood cooking aid was analyzed like in Example 1 and the results were:

| | | |
|---|---|---|
| Dry substance content: | 35.1% | Infra-red drier, 160° C., 15 minutes. |
| Free alkaline content: | 0.068% | HCl titration |
| Viscosity at 50° C.: | 762 mPa * s | Brookfield |
| Viscosity at 90° C.: | 75 mPa * s | Brookfield |

Here the rosin acid content which was as high as 92.3% gave the product a viscosity which was low enough to enable pumping within a large range of temperatures.

EXAMPLE 5

A composition according to the present invention was prepared by mixing together 81.4. g tall oil rosin and 18.6 g tallow fatty acid in which the main components were oleic acid, palmitic acid and stearic acid. Rosin acid content in this mixture was 72.1%, fatty acid content 23.3% and unsaponifiables 4.6%.

127.2 g water, 8.8 g sodium hydroxide and 64.3 g above prepared composition was placed into a pressure reactor. The temperature of the reactor was raised to 120° C. and the mixture was mixed for 30 minutes. After this the reactor was cooled down to room temperature.

The rosin wood cooking aid was analyzed and the results were:

| | | |
|---|---|---|
| Dry substance content: | 34.5% | Infra-red drier, 160° C., 15 minutes. |
| Free alkaline content: | 0.134% | HCl titration |
| Viscosity at 50° C.: | 55 mPa * s | Brookfield |
| Viscosity at 90° C.: | 21 mPa * s | Brookfield |

The composition worked well in the removal of extractives in the cooking of batches containing birch.

EXAMPLE 6

A composition according to the present invention was prepared by mixing together 81.4 g tall oil rosin and 18.6 g coconut oil fatty acid in which the main components were lauric acid, myristic acid and palmitic acid. The rosin acid content in this mixture was 71.0%, fatty acid content 24.3% and the unsaponifiables 4.7%.

123.5 g water, 9.3 g sodium hydroxide and 64.3 g of the above prepared composition were placed in a pressure reactor. The temperature of the reactor was raised to 120° C. and the mixture was mixed for 30 minutes. After this the reactor was cooled down to room temperature.

The rosin wood cooking aid was analyzed and the results were:

| | | |
|---|---|---|
| Dry substance content: | 34.7% | Infra-red drier, 160° C., 15 minutes. |
| Free alkaline content: | 0.16% | HCl titration |
| Viscosity at 50° C.: | 49.6 mPa * s | Brookfield |
| Viscosity at 90° C.: | 17 mPa * s | Brookfield |

The composition operated well with various cooks of hardwood.

The present invention has been illustrated in detail by the above examples. It is evident to those skilled in the art that the invention may be used in many different ways and many different applications.

The invention claimed is:

1. A wood cooking mixture comprising hardwood particles and a wood cooking aid, wherein the wood cooking aid comprises a fatty acid component and a rosin acid component and/or salts thereof, and wherein said wood cooking aid comprises about 70 to about 2% fatty acids, about 20 to about 98% rosin acids, and less than about 15% unsaponifiable material;

said fatty acids comprise a monomer part produced during dimerization of fatty acids; and said monomer part contains branched oleic acids 13 to 20%, branched stearic acids 7 to 20%, oleic acid 15 to 25% and other fatty acids 28 to 58%, the rest being unsaponifiable material.

2. A wood cooking mixture comprising hardwood particles and a wood cooking aid, wherein the wood cooking aid comprises a fatty acid component and a rosin acid component and/or salts thereof, and wherein said wood cooking aid comprises about 70 to about 2% fatty acids, about 20 to about 98% rosin acids, and less than about 15% unsaponifiable material; said fatty acids comprise a monomer part produced during dimerization of fatty acids; and the fatty acid distribution of said monomer part is branched oleic acids about 14 to about 16%, branched stearic acid about 13 to about 15%, oleic acid about 19 to about 21% and other fatty acids about 42 to about 44%.

3. The wood cooking mixture of claim 2 wherein said hardwood particles are birch particles.

4. A method for processing hardwood particles comprising: contacting hardwood particles with a wood cooking aid, said wood cooking aid comprising a fatty acid component and a rosin acid component and/or salts thereof, and wherein said wood cooking aid comprises about 70 to about 2% fatty acids, about 20 to about 98% rosin acids, and less than about 15% unsaponifiable material; said fatty acids comprise a monomer part produced during dimerization of fatty acids; and the fatty acid distribution of said monomer part is branched oleic acids about 14 to about 16%, branched stearic acid about 13 to about 15%, oleic acid about 19 to about 21% and other fatty acids about 42 to about 44%.

5. The method of claim 4 wherein said hardwood particles are birch particles.

6. A method for cooking hardwood comprising the steps of:

i) contacting hardwood particles with a cooking liquor comprising a cooking aid, and ii) heating said particles and liquor to a temperature between 140° C. and 180° C., wherein said cooking aid comprises a blended mixture of about 70 to about 2% fatty acids, about 20 to about 98% rosin acids and less than about 15% unsaponifiable material, and wherein said fatly acids comprise a monomer part produced during dimerization of fatty acids.

7. The method of claim 6 wherein said hardwood particles are birch particles.

8. The method of claim 6 wherein the fatty acid distribution of said monomer part is branched oleic acids about 14 to about 16%, branched stearic acid about 13 to about 15%, oleic acid about 19 to about 21% and other fatty acids about 42 to about 44%.

9. The method of claim 8 wherein said hardwood particles are birch particles.

* * * * *